United States Patent [19]

Rombach et al.

[11] Patent Number: 4,473,751

[45] Date of Patent: Sep. 25, 1984

[54] NON-CONVENTIONAL RECIPROCATING HYDRAULIC-ELECTRIC POWER SOURCE

[75] Inventors: James C. Rombach, Burbank; James L. Coakley, Fillmore, both of Calif.

[73] Assignee: HR Textron Inc., Valencia, Calif.

[21] Appl. No.: 348,376

[22] Filed: Feb. 12, 1982

[51] Int. Cl.[3] ..... F03C 1/18

[52] U.S. Cl. ..... 290/1 R; 91/349

[58] Field of Search ..... 290/1 R; 91/339, 349

[56] References Cited

U.S. PATENT DOCUMENTS

| | | | |
|---|---|---|---|
| 165,646 | 7/1875 | Winchester | 91/349 |
| 1,663,666 | 3/1928 | Moskovitz et al. | 91/349 |
| 2,944,160 | 7/1960 | Dickinson | 290/1 R |
| 3,629,596 | 12/1971 | Wills | 290/1 |
| 3,675,031 | 7/1972 | Lavigne | 290/1 |
| 4,154,200 | 5/1979 | Jarret et al. | 290/1 R |
| 4,342,920 | 8/1982 | Bucknam | 290/1 R |

FOREIGN PATENT DOCUMENTS

| | | | |
|---|---|---|---|
| 485 | of 1875 | United Kingdom | 91/349 |

*Primary Examiner*—G. Z. Rubinson
*Assistant Examiner*—W. E. Duncanson, Jr.
*Attorney, Agent, or Firm*—Nilsson, Robbins, Dalgarn, Berliner, Carson & Wurst

[57] ABSTRACT

A non-conventional electric power source including a reciprocating hydraulically powered ram coupled to an electric generator. A pair of matched nozzles coupling a hydraulic fluid supply to the ram. Reciprocation of the ram is effected by a flapper disposed between the nozzles which alternatingly cuts off hydraulic fluid flow through the nozzles responsive to the ram approaching its travel limit.

5 Claims, 4 Drawing Figures

NON-CONVENTIONAL RECIPROCATING HYDRAULIC-ELECTRIC POWER SOURCE

BACKGROUND OF THE INVENTION

The need sometimes arises for a self contained small power generating unit providing relatively small amounts of electrical power which is relatively immune to hostile environments. One such application is in aircraft.

In such aircraft, it has been traditional to supply both electrical power and electrical control signals to electrohydraulic servovalves for positioning aircraft control surfaces through wire harnesses run throughout the aircraft. Such wiring renders the aircraft susceptible to hostile environments such as lightning and the like. In some instances pursuant to current practice, electrohydraulic servovalves are controlled by light signals as opposed to electrical signals. However, the power required by the amplifiers for driving the electrohydraulic servovalves must be obtained other than from a central power source to preclude long runs of electrical wiring. By providing an isolated electric power source ("source", hereafter) capable of running the amplifier at the hydraulic actuator which, for example, moves the control surfaces or the like, the need for long runs of electrical wiring can be eliminated. Such thus reduces the susceptibility of the aircraft to failure from hostile environments.

The prior art known to applicants consists of U.S. Pat. Nos. 3,094,635, 3,119,940 and 3,568,704.

SUMMARY OF THE INVENTION

A non-conventional electric power source including a reciprocating ram connected through a pair of passageways to a supply of hydraulic fluid under pressure. Means alternately blocking said passageways responsive to said ram approaching its travel limit to effect the reciprocation. An electric generator is coupled to said ram.

More specifically, there is provided a a pair of matched nozzles coupling the hydraulic pressure supply to the ram. A flapper is disposed between the nozzles for controlling flow of hydraulic fluid under pressure from the supply thereof alternatively through the nozzles to the ram. The flapper has first and second stable positions but is statically unstable when centered between the two nozzles, thereby causing the flapper to snap from one nozzle to the other to thereby effect direction reversal of the actuator.

DETAILED DESCRIPTION

Figure 1:
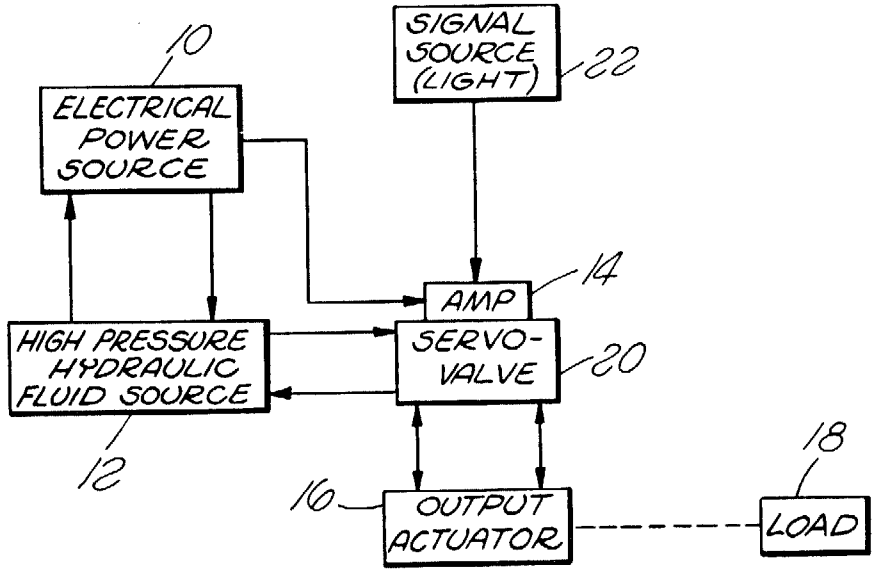
FIG. 1 is a block diagram of one application of the power source constructed in accordance with the present invention.

Referring now to FIG. 1 there is generally shown one application for the non-conventional electric power source constructed in accordance with the present invention. As is therein shown an electrical power source

10 is coupled to receive hydraulic fluid from a high pressure hydraulic fluid supply 12 and has the output power from the electrical source 10 connected to an amplifier 14 which drives a standard electrohydraulic servovalve. The system, generally as shown in FIG. 1, is the typical electrohydraulic servovalve used to control an output actuator 16 which is mechanically coupled to an appropriate load 18 such as an aircraft control surface. According to the present state of the art, the control signals supplied to the amplifier 14 for appropriate positioning of the servovalve 20 to control the flow of fluid from the source 12 to the actuator 16 may be in the form of light and emanate from an appropriate signal source 22. As is well known to those skilled in the art the signal source 22 may be any type of apparatus, such for example as a pilot's control column, output signals from the autopilot, signals generated by various sensing devices positioned throughout the aircraft or the like. In any event through the utilization of light as the means for transmission of the control signals, optical fibers are positioned to transmit the signals to the amplifier 14. These optical fibers, which are immune to electromagnetic disturbances, eliminate electrical wiring throughout the aircraft for transmission of control signals thereby eliminating one element capable of transmitting electromagnetic disturbances to the amplifier. Even though the utilization of light as a means for transmitting the signals eliminated the necessity for some electrical wiring, electrical power is still required to operate the amplifier 14 to cause the servovalve 20 to function properly in response to the commands contained within the control signals emanating from the source 22. If a central electrical power source is utilized, one would then be required to string wire from that source of the amplifier 14. This wire offers the possibility of electromagnetic disturbances being transmitted to the amplifier. Therefore, in accordance with the present invention, an electrical generator has been provided which utilizes the high pressure hydraulic fluid source 12 already required to operate the output actuator 16 in accordance with the positioning of the servovalve 20. Thus the electrical power source 10 taps a small amount of the high pressure hydraulic fluid to generate sufficient power to operate the amplifier 14. For example, one typical power requirement is 18 volts direct current at 0.1 to 1.0 watts.

Figure 2:
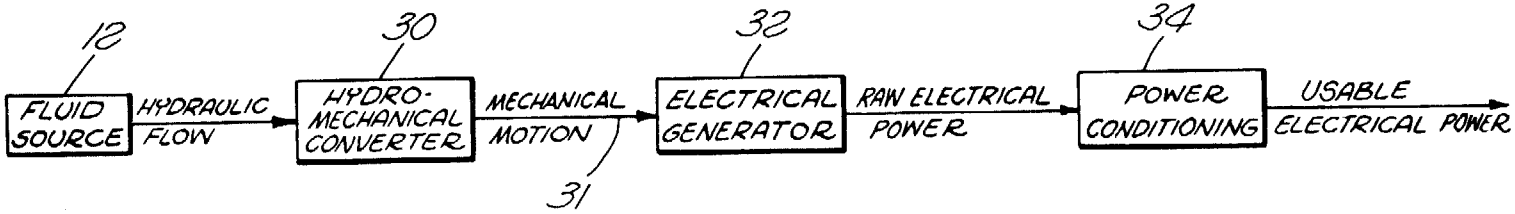
FIG. 2 is a block diagram illustrating generally the power source of the present invention.

As illustrated in the block diagram of FIG. 2, the electrical power source 10 includes a hydromechanical converter 30 which receives hydraulic fluid flow from the fluid supply 12, thereby converting the hydraulic fluid flow into mechanical motion. The mechanical motion is then coupled as shown by the arrow 31 to an electrical generator 32. The electrical generator provides an electrical output signal which is alternating in character and the wave form of which is determined by the type of motion generated by the converter 30 and the type of generator 32 employed. A power conditioning means 34 is utilized to change the raw electrical power into usable electrical power which is then applied, for example, to the amplifier 14. The power conditioning apparatus 34 may, for example, be a typical rectifier and filter and if required, appropriate regulating means, all of which is well known to the art.

Figure 3:
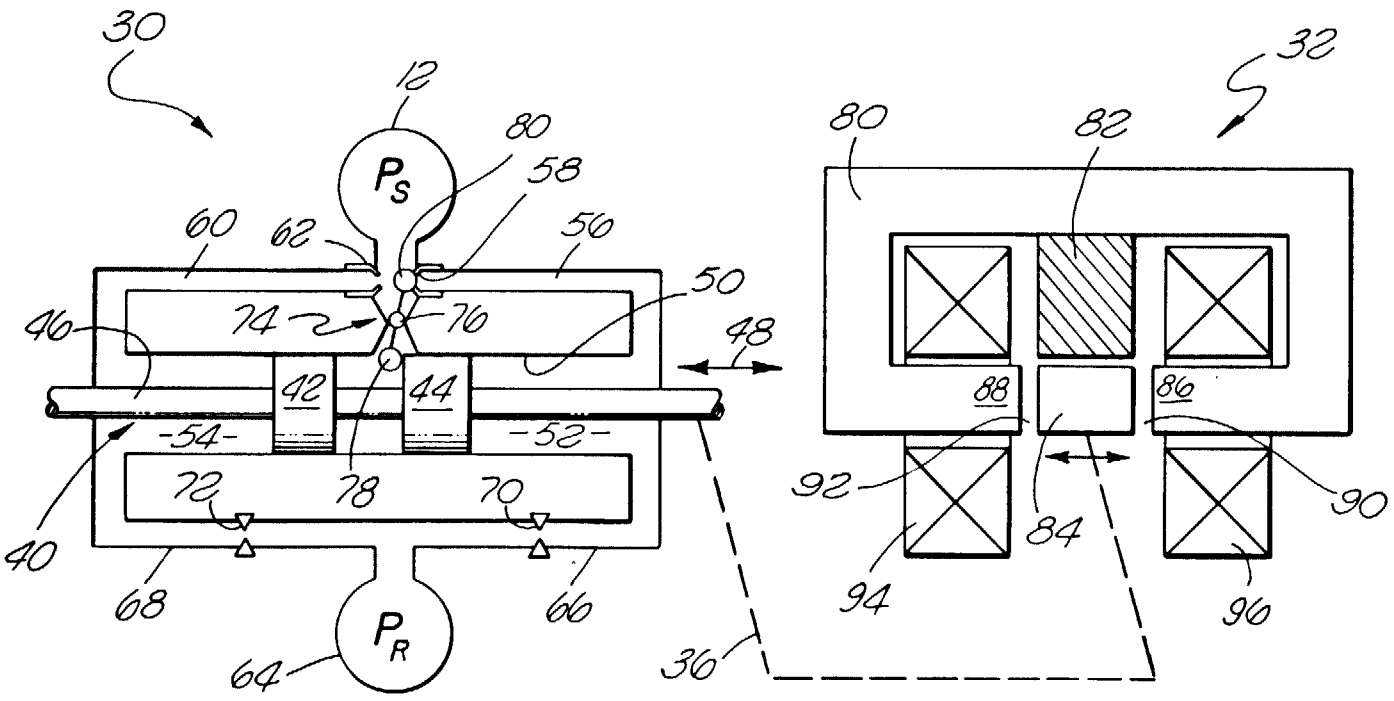
FIG. 3 is a schematic representation of the power source of the present invention.

Referring now to FIG. 3 the non-conventional electric power source in accordance with the present invention is illustrated in schematic form. As is therein shown the hydromechanical converter 30 is shown coupled to the electrical generator 32 by means of a dashed line 36. The converter 30 includes a hydraulic ram 40 having a piston in two sections 42 and 44 spaced apart upon a piston rod 46 for reciprocal movement as shown by the arrow 48 within a cylinder 50 having chambers 52 and 54. A passageway 56 is connected between the chamber 52 and a nozzle 58 while passageway 60 is connected between the chamber 54 and a nozzle 62. The supply 12 of hydraulic fluid under pressure is as illustrated in FIG. 3 connected so that flow of hydraulic fluid is from the source 12 through the nozzles 58 and 62 to the fluid return 64. The return 64 is connected to the chamber 52 by way of the passageway 66 and to the chamber 54 by way of the passageway 68. Restriction orifices 70 and 72 are positioned within the passageway 66 and 68 to provide sufficient pressure to operate the ram 40.

The flapper shown generally at 74 is shown pivoted at 76 with one end thereof terminating at 78 between the pistons 42 and 44 while the opposite end 80 is positioned between the orifices of the nozzles 58 and 62. Those skilled in the art will note that a schematic diagram of FIG. 3 illustrates the flapper pivoted between the piston and the nozzles. Such illustration provides direct porting to the ram 40 and facilitates understanding the operation of the hydromechanical converter. However, those skilled in the art will also recognize that in actual practice the flapper preferably will be a cantilevered flapper of a typical servovalve type but appropriately designed to provide the desired spring constants to effect "snap action" as will be discussed hereinbelow.

As will be noted the flapper 74 alternately directs the hydraulic fluid under pressure to one of the chambers 52 and 54, depending upon its position, to thereby direct the pressure to piston 42 or 44 to cause the ram 40 to reciprocate. Due to hydraulic forces the flapper has an unstable equilibrium point when precisely centered between the two nozzles 58 and 62. At any other position the supply pressure from the source 12 impels the flapper toward that nozzle which is closest to the flapper. This results in what is referred to as negative stiffness. As the piston approaches the end of its stroke, it contacts the end 78 of the flapper 74 and mechanically drives the flapper from one nozzle orifice to the other nozzle orifice, thus reversing the direction of flow of the fluid and thereby the direction of motion of the ram 40. As will be understood by those skilled in the art, it is imperative that the flapper have a stiffness less than the absolute value of the hydraulic negative stiffness characteristic of the flapper in order to assure a "snap action" from one nozzle to the other on each direction reversal.

It is desirable that the ram 40 travel at constant speed in each direction to provide the desired electrical output signal. Such is accomplished by sizing the orifices of the nozzles 58 and 62 substantially identical to each other and by also sizing the restriction orifices 70 and 72 substantially identical to each other. Under these circumstances, the output motion is such that a square wave is generated by the electrical generator.

As illustrated in FIG. 3, the electrical generator includes an iron pole piece 80, an iron armature 84 and a permanent magnet 82. At the midpoint of the stroke of the hydraulic ram 40, the armature 84 is centered between the ends 86 and 88 of the pole piece 80 creating equal working air gaps 90 and 92. In this condition the magnetic flux generated by permanent magnet 82 divides equally between the arms 86 and 88 of pole piece 80. As the armature 84 is driven symmetrically about this midpoint the magnetic flux alternately increases in one arm while decreasing in the other arm of pole piece 80. Appropriate coils 94 and 96 are wound about the pole 80 and through variation of the magnetic flux in the arms 86, 88 of the pole 80 by armature reciprocation produces a voltage in the respective coil. By connecting the coils in a series aiding fashion, the voltages generated are summed as is well known in the art. The balanced configuration is chosen because a reasonably constant reluctance load is placed on permanent magnet 82 as armature 84 translates varying air gaps 90 and 92.

As the ram 40 reciprocates, the armature 84 which is connected thereto is driven symmetrically about the midpoint where the two working gaps 90 and 92 are equal. As above noted, the magnetic flux is established in each of the two parallel paths provided by the pole 80 by the permanent magnet. In the absence of any lags in flux build up, midstroke of the armature 84 equal flux appears in each of the two magnetic paths. Similarly, at maximum stoke, there is a maximum amount of magnetic flux in the path of the shorter working gap and a minimum amount of flux in the path of the longer working gap. On each half cycle the flux in one path increases from the minimum value to the maximum value while the flux in the other path decreases from the maximum value to the minimum value. The changing magnetic field in each case thus produces a voltage in its respective coil 94 or 96. When current is drawn from the generator, the current in the coils produces a countermagnetic coercive force opposing the coercive of the permanent magnet in the gap where flux is increasing and aiding it in the gap where flux is decreasing. The voltage at any load is less than the no-load voltage due to this effect and the drop due to the resistance of the wire in the coils. The magnitude of the drop due to either effect can be held to any selected valve by appropriate choice of design parameters as is well known to those skilled in the art.

Figure 4:
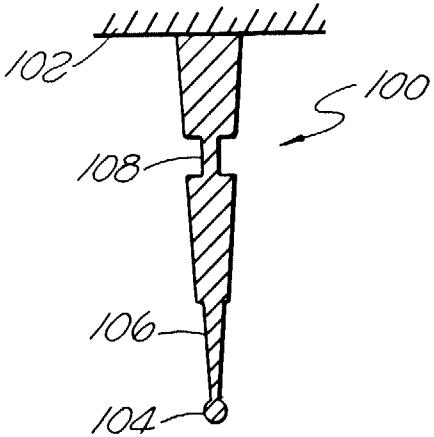
FIG. 4 is a schematic representation of one type of flapper usable with the power source of the present invention.

As above referred to the flapper will traditionally be a cantilevered flapper of the type typically used in flapper nozzle servovalves but appropriately designed to accomplish the "snap action" above referred to. Such a flapper is shown in FIG. 4 to which reference is hereby made. As is therein shown a typical flapper 100 is anchored as illustrated at 102 within the housing of the hydromechanical converter. The terminus 104 fits between the pistons on the ram as above described. The lower portion 106 of the flapper 100 is designed to flex as the ram moves in its reciprocal motion. The upper portion of the flapper 100 has a reduced area section 108 which serves as a flexure pivot for the flapper. Its stiffness is additive to the stiffness of the flexing portion 106 of the flapper in determining the snap action as above described, thus causing the flapper to move from blocking engagement with one nozzle orifice to blocking engagement with the other nozzle orifice, cutting off flow therethrough and causing reversal of the ram 40 as above described.

Those skilled in the art will recognize that through the utilization of the non-conventional electric power source as above described, and at the power levels above referred to, one can provide an electrical power source which is extremely small in size and thus can be packaged at the output actuator along with the servovalve. Such small electrical power sources are thus relatively isolated from any hostile environment and if several output actuators are utilized on a particular vehicle a separate electrical power source can be provided at each thereof thus again eliminating the necessity of large amounts of wire being strung throughout the vehicle. It will furthermore be recognized by those skilled in the art that if such is desired, several such non-conventional electrical power sources may be utilized to provide redundant operation of the amplifier 14 in each area thereby increasing reliability of any of the structures where such is needed.

Use of conventional rotary generators are traditionally load sensitive in that as current is drawn the speed thereof reduces, causing the voltage to drop. Additional components (adding size and weight for an airborne application) are required to alleviate this tendancy. By utilizing a reciprocating apparatus of the present invention, the speed is largely determined by the selection of orifice size for the nozzles and restriction orifices, load having minimal effect.

What is claimed is:

1. Apparatus for converting hydraulic energy to electrical energy comprising:

(A) a reciprocating hydraulically powered ram;

(B) electrical generator means coupled to said ram;

(C) a supply of hydraulic fluid under pressure;

(D) means coupling said fluid supply to said ram through alternative flow paths for effecting reciprocation of said ram responsive to said ram approaching the limit of its travel including:

(1) a pair of matching nozzles, (2) flapper means disposed between said nozzles for alternately blocking one of said nozzles and thereby one of said flow paths while permitting fluid to flow from said supply through the other of said flow paths, (3) a pair of mated restriction orifices, one of which is disposed in each of said fluid flow paths downstream of each of said matched nozzles, and (4) one end of said flapper engaging said ram for moving said flapper from a position blocking one of said nozzles to a position blocking the other of said nozzles as said ram approaches the limit of its travel, said flapper moving from its blocking engagement with one nozzle into blocking engagement with the other nozzle by snap action.

2. Apparatus as defined in claim 1 wherein said electrical generator means includes a magnetic flux path means defining a gap therein, an armature means positioned in said gap to provide a pair of working gaps in said magnetic flux path means, a permanent magnet affixed to said magnetic flux path means for providing substantially equal magnetic flux through each working gap when said armature is symmetrically positioned within said gap, and a coil positioned adjacent each said working gap.

3. Apparatus as defined in claim 1 wherein said flapper means is a cantilevered flapper having a reduced area midsection to provide a flexure pivot to enable said snap action.

4. Apparatus as defined in claim 3 wherein said ram includes a pair of spaced apart pistons with one end of said flapper disposed therebetween.

5. Apparatus as defined in claim 1 wherein said electrical generator means includes a magnetic flux path means defining a gap therein, armature means positioned in said gap, a permanent magnet affixed to said magnetic flux path means for providing magnetic flux therein and in said gap, means coupling said armature to said ram for reciprocation of said armature in said gap, and a coil positioned adjacent said path for generating electric power as the flux in said path varies because of armature reciprocation.

* * * * *